US009248677B2

(12) United States Patent
Takada et al.

(10) Patent No.: US 9,248,677 B2
(45) Date of Patent: Feb. 2, 2016

(54) FLUID EJECTION MODULE MOUNTING

(71) Applicant: FUJIFILM Corporation, Tokyo (JP)

(72) Inventors: Norihisa Takada, Kanagawa (JP); Steve Deming, San Jose, CA (US); Kevin von Essen, San Jose, CA (US); Michael Rocchio, Hayward, CA (US); John A. Higginson, Santa Clara, CA (US)

(73) Assignee: FUJIFILM Corporation, Tokyo (JP)

( * ) Notice: Subject to any disclaimer, the term of this patent is extended or adjusted under 35 U.S.C. 154(b) by 318 days.

(21) Appl. No.: 13/793,748

(22) Filed: Mar. 11, 2013

(65) Prior Publication Data

US 2013/0292529 A1 Nov. 7, 2013

Related U.S. Application Data

(60) Provisional application No. 61/641,227, filed on May 1, 2012.

(51) Int. Cl.

| | |
|---|---|
| ***B41J 25/308*** | (2006.01) |
| ***B41J 29/393*** | (2006.01) |
| ***B41J 2/015*** | (2006.01) |
| ***B41J 29/00*** | (2006.01) |
| ***B41J 25/34*** | (2006.01) |

(52) U.S. Cl.

CPC ..... *B41J 29/00* (2013.01); *B41J 25/3086* (2013.01); *B41J 25/34* (2013.01); *Y10T 29/49895* (2015.01)

(58) Field of Classification Search

USPC ..... 347/8, 19, 20

See application file for complete search history.

(56) References Cited

U.S. PATENT DOCUMENTS

| | | | | |
|---|---|---|---|---|
| 5,366,302 | A | 11/1994 | Masumura et al. | |
| 2005/0134672 | A1* | 6/2005 | Williams et al. | 347/214 |
| 2006/0132529 | A1 | 6/2006 | Verhoest et al. | |
| 2010/0045729 | A1* | 2/2010 | Tharion et al. | 347/19 |
| 2010/0245415 | A1* | 9/2010 | Tsai et al. | 347/8 |
| 2011/0080449 | A1 | 4/2011 | von Essen et al. | |
| 2011/0109696 | A1 | 5/2011 | Essen | |
| 2012/0044310 | A1 | 2/2012 | Yajima et al. | |

FOREIGN PATENT DOCUMENTS

| | | |
|---|---|---|
| JP | 2001-162892 | 6/2001 |
| JP | 2005-219435 | 8/2005 |
| JP | 2012-040743 | 3/2012 |
| WO | 99/32301 | 7/1999 |

(Continued)

OTHER PUBLICATIONS

Japanese Office Action (with partial English translation) issued in Application No. JP 2013-088617, on Nov. 10, 2014.

(Continued)

*Primary Examiner* — Jason Uhlenhake
(74) *Attorney, Agent, or Firm* — Fish & Richardson P.C.

(57) ABSTRACT

A bracket includes a support strut configured to carry the fluid ejection module and an alignment strut coupled to the support strut. The alignment strut is configured to affix to the frame so as to orient the support strut with respect to the frame in each of three orthogonal linear directions and three orthogonal angular directions. The alignment strut includes three alignment mechanisms. Each of the first and second alignment features is held mechanically fixed on the alignment strut in a respective aligned position, and the third alignment mechanism is movable on the alignment strut.

20 Claims, 6 Drawing Sheets

(56) References Cited

FOREIGN PATENT DOCUMENTS

| | | |
|---|---|---|
| WO | 2008/152903 | 12/2008 |
| WO | 2009/142927 | 11/2009 |

OTHER PUBLICATIONS

Extended European Search Report mailed Jul. 25, 2013 in corresponding European application No. 13164667.1, 7 pgs.

* cited by examiner

FLUID EJECTION MODULE MOUNTING

PRIORITY CLAIM

This application claims the benefit of U.S. Provisional Patent Application No. 61/641,227, filed May 1, 2012. The entire contents of the foregoing are incorporated herein by reference.

TECHNICAL FIELD

The following description relates to mounting a fluid ejection module to a print frame.

BACKGROUND

An ink jet printer typically includes an ink path from an ink supply to an ink nozzle assembly that includes nozzles from which ink drops are ejected. Ink drop ejection can be controlled by pressurizing ink in the ink path with an actuator, for example, a piezoelectric deflector, a thermal bubble jet generator, or an electrostatically deflected element. A typical printhead has a line or an array of nozzles with a corresponding array of ink paths and associated actuators, and drop ejection from each nozzle can be independently controlled. In a so-called "drop-on-demand" printhead, each actuator is fired to selectively eject a drop at a specific location on a medium. The printhead and the medium can be moving relative one another during a printing operation.

As one example, a printhead can include a semiconductor printhead body and a piezoelectric actuator. The printhead body can be made of silicon etched to define pumping chambers. Nozzles can be defined by a separate layer that is attached to the printhead body. The piezoelectric actuator can have a layer of piezoelectric material that changes geometry, or flexes, in response to an applied voltage. Flexing of the piezoelectric layer pressurizes ink in a pumping chamber located along the ink path.

Printing accuracy can be influenced by a number of factors. Precisely positioning the nozzles relative to the medium can be necessary for precision printing. If multiple printheads are used to print contemporaneously, then precise alignment of the nozzles included in the printheads relative to one another also can be critical for precision printing. Maintaining alignment of the printheads during and after alignment and mounting can be important.

SUMMARY

In one aspect, the systems, apparatus, and methods disclosed herein feature a bracket for mounting a fluid ejection module to a frame. The bracket includes a support strut configured to carry the fluid ejection module and an alignment strut coupled to the support strut. The alignment strut is configured to affix to the frame so as to orient the support strut with respect to the frame in each of three orthogonal linear directions and three orthogonal angular directions. The alignment strut includes a first alignment mechanism including a first adjustable alignment feature configured to orient the support strut in a first angular direction when the alignment strut is affixed to the frame. The alignment strut also includes a second alignment mechanism including a second adjustable alignment feature and being configured to orient the support strut in a second angular direction and in a third linear direction when the alignment strut is affixed to the frame. The alignment strut also includes a third alignment mechanism including a third adjustable alignment feature and being configured to orient the support strut in a first linear direction when the alignment strut is affixed to the frame. Each of the first and second alignment features is held mechanically fixed on the alignment strut in a respective aligned position, and the third alignment mechanism is movable on the alignment strut.

In various implementations, the alignment strut is affixed to the frame such that the first, second, and third alignment features are in contact with the frame. The aligned position of the first alignment feature can be a position that causes the support strut to be level with respect to the frame in the first angular direction and/or the second angular direction.

In various implementations, the first and second alignment features are held mechanically fixed by an adhesive.

In various implementations, the support strut is substantially perpendicular to the alignment strut.

In various implementations, the first alignment mechanism includes a cam device positioned at a distal end of the alignment strut, relative to the support strut. The cam device can include a cam including the first alignment feature, a drive screw functionally coupled to the cam such that actuation of the drive screw drives the cam in the second linear direction.

In various implementations, the second alignment mechanism includes a pair of cam devices positioned on opposing lateral sides of the alignment strut. Each of the cam devices can include a cam including the second alignment feature, and a drive screw functionally coupled to the cam such that actuation of the drive screw drives the cam in the third linear direction. Each of the cam devices can be adjustable independently of the other cam device.

In various implementations, the third alignment mechanism includes a cam device positioned at a proximal end of the alignment strut relative to the support strut.

In various implementations, the bracket also includes a fourth alignment feature configured to orient the support strut in a second linear direction when the alignment strut is affixed to the frame.

In various implementations, the alignment strut defines a guide slot configured to receive a mechanical locking component for affixing the alignment strut to the frame.

In another aspect, the systems, apparatus, and methods disclosed herein feature a method for pre-aligning a bracket. The method can include the sequence of: coupling the bracket to a base frame of an alignment apparatus; determining, using the alignment apparatus, an orientation of the bracket with respect to the base frame; comparing the orientation of the bracket to reference calibration data; adjusting at least one of the first and second alignment mechanisms of the bracket based on the comparison; and mechanically fixing at least one of the first and second alignment mechanisms in place.

In various implementations, determining the orientation of the bracket includes measuring a coordinate value at each of a plurality of positions on a surface of the fluid ejection module. Adjusting the first and second alignment mechanisms can include adjusting the first and second alignment mechanisms such that each of the measured coordinate values matches, within a predetermined threshold, a corresponding target coordinate value of the calibration data. Measuring the coordinate values can include contacting each of the positions on the surface of the fluid ejection module with pins of a height gauge.

In various implementations, a movable cam of the first alignment system can provide the first alignment feature, and adjusting at least one of the first and second alignment mechanisms can include moving the cam in the second linear direction relative to the base frame.

In various implementations, a pair of independently movable cams of the second alignment mechanism can provide the second alignment feature, and adjusting at least one of the first and second alignment mechanisms includes independently moving the cams in the third linear direction relative to the base frame.

In various implementations, the method can also include securing the fluid ejection module to the support strut in an aligned position. Securing the fluid ejection module to the support strut can include, before determining the orientation of the bracket, implementing a rough fiducial alignment of the fluid ejection module with respect to the support strut. Securing the fluid ejection module to the support strut can include, after adjusting at least one of the first and second alignment mechanisms, implementing a fine fiducial alignment of the fluid ejection module with respect to the support strut. Securing the fluid ejection module to the support strut can include using an adhesive to bond the fluid ejection module to the support strut.

In various implementations, the method can also include obtaining the reference calibration data by coupling a reference gauge component to the base frame of the alignment apparatus, and determining, using the alignment apparatus, an orientation of the reference gauge with respect to the base frame.

In various implementations, mechanically fixing at least one of the first and second alignment mechanisms in place includes leaving a third alignment feature of the bracket adjustable.

In yet another aspect, the systems, apparatus, and methods disclosed herein feature a bracket for mounting a fluid ejection module to a frame. The bracket includes a support strut configured to carry the fluid ejection module, and an alignment strut coupled to the support strut. The alignment strut is configured to affix to the frame so as to orient the support strut with respect to the frame in each of three orthogonal linear directions and three orthogonal angular directions. The alignment strut includes a first alignment mechanism including a first cam movable in a second linear direction, the first cam positioned at a distal end of the alignment strut relative to the support strut. The alignment strut also includes a second alignment mechanism including a pair of second cams movable in a third linear direction, the pair of second cams positioned on opposing lateral side flanges of the alignment strut. The alignment strut also includes a third alignment mechanism including a third cam movable in a second angular direction, the third cam positioned at a proximal end of the alignment strut relative to the support strut.

Implementations of the invention(s) can realize one or more of the following advantages. A mounting bracket is provided to achieve precise alignment of a fluid ejection module relative to a supporting print frame. The mounting bracket can facilitate easy installation and removal of the fluid ejection module from the print frame, for example, to replace or repair the device. Further, the mounting bracket can be manufactured with lower dimensional tolerances because various components (e.g., alignment mechanisms) are provided to adjust the orientation of the bracket relative to the print frame.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Many of the levels, sections and features are exaggerated to better show the features, process steps, and results. Like reference numbers and designations in the various drawings indicate like elements.

DETAILED DESCRIPTION

A method, apparatus, and system are described for mounting a fluid ejection module to a frame (which may be referred to herein as a "print frame" or a "print bar") of a printer system. A typical printer system may include one or several fluid ejection modules. When combining two or more fluid ejection modules in a printing system, each device can be aligned relative to the print frame, and relative to one another, to achieve printing accuracy.

A bracket for mounting a fluid ejection module to a print frame can include a support strut for carrying the fluid ejection module, and an alignment strut for attaching the bracket to the frame. The alignment strut can include several components for aligning the bracket relative to the print frame. For example, the alignment strut can include multiple alignment mechanisms that are adjustable to facilitate proper alignment of the bracket with the print frame. When the bracket is completely installed, the alignment mechanisms are mechanically fixed in place (e.g., immobile) to secure the orientation of the bracket with respect to the print frame.

Figure 1:
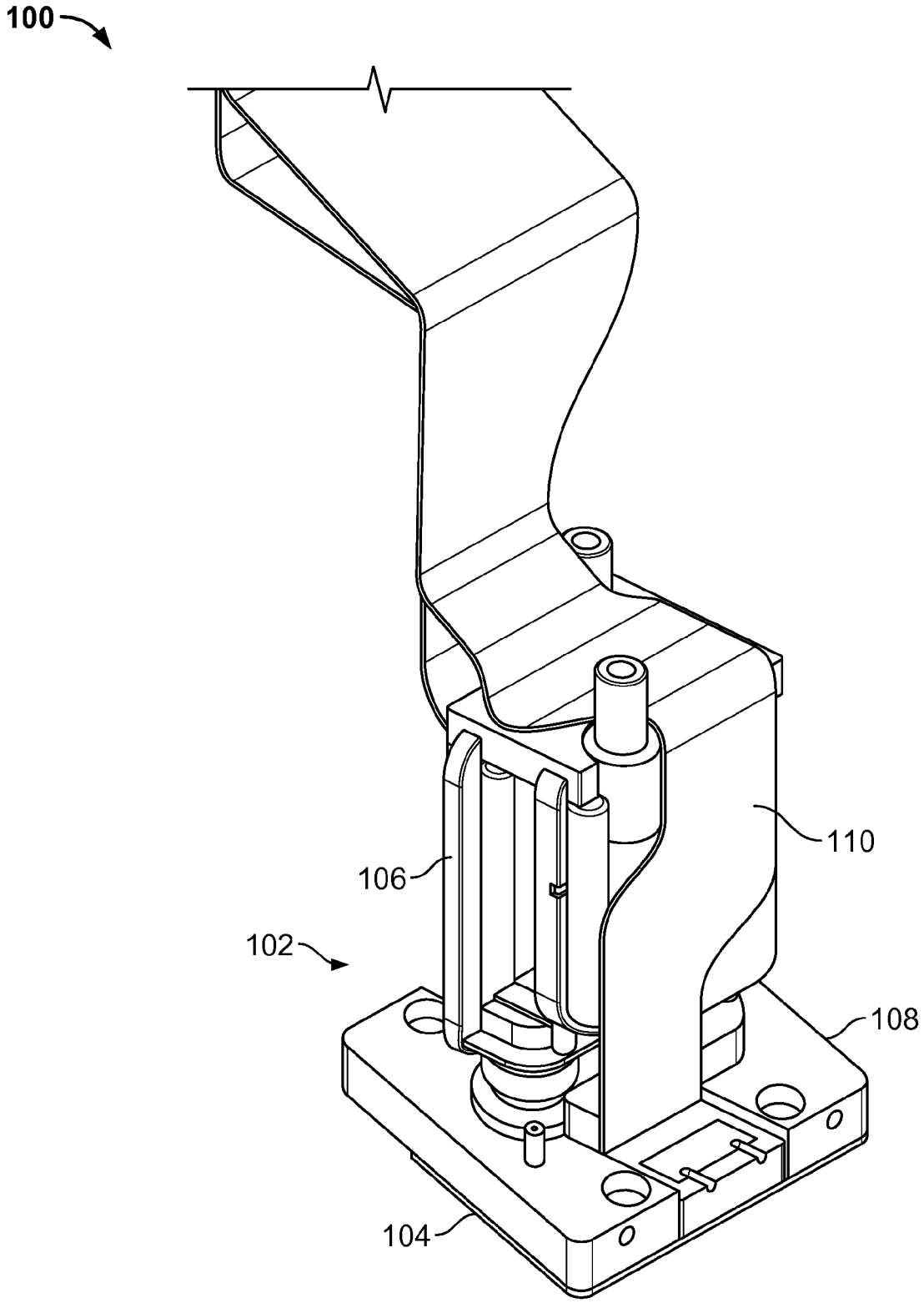
FIG. 1 is a perspective view of a fluid ejection module.

FIG. 1 shows an exemplary fluid ejection module 100 that can be incorporated in a printer system. The fluid ejection module 100 includes a printhead 102 for depositing droplets of fluid on a print medium, and a flexible circuit 110, coupled to the printhead, that electrically connects the fluid ejection module to a printer system (not shown). For example, the flexible circuit 110 can be configured to receive data from a processor of the printer system and to provide drive signals to the printhead 102.

The printhead 102 includes a die 104 configured for ejection of fluid droplets. The fluid can be, for example, an ink, chemical compound or any other suitable fluid (e.g., biological liquids). The die 104 can be a multi-layered substrate in which numerous fluid flow paths are formed. In one implementation, each of the flow paths includes a fluid inlet, an ascender, a pumping chamber, and a descender that terminates in a nozzle. Of course, other suitable flow path configurations can also be used. The die 104 can also include a set of actuators that cause drops of fluid to be selectively ejected from the nozzles. In some examples, each flow path is associated with a respective actuator. For example, activation of an actuator can cause a membrane secured above a flow path to deflect into the pumping chamber, forcing a drop of fluid from the nozzle. Activation of the actuators can be controlled by electronic signals provided by the flexible circuit 110. As shown, the printhead 102 also includes a housing 106 to provide fluid to the die 104 and to dispose of or recirculate any un-ejected fluid, as well as a mounting component 108 that can be used in conjunction with an appropriate mounting bracket (e.g., mounting bracket 112, see FIG. 2) to secure the fluid ejection module 100 to a print frame.

Figure 2:
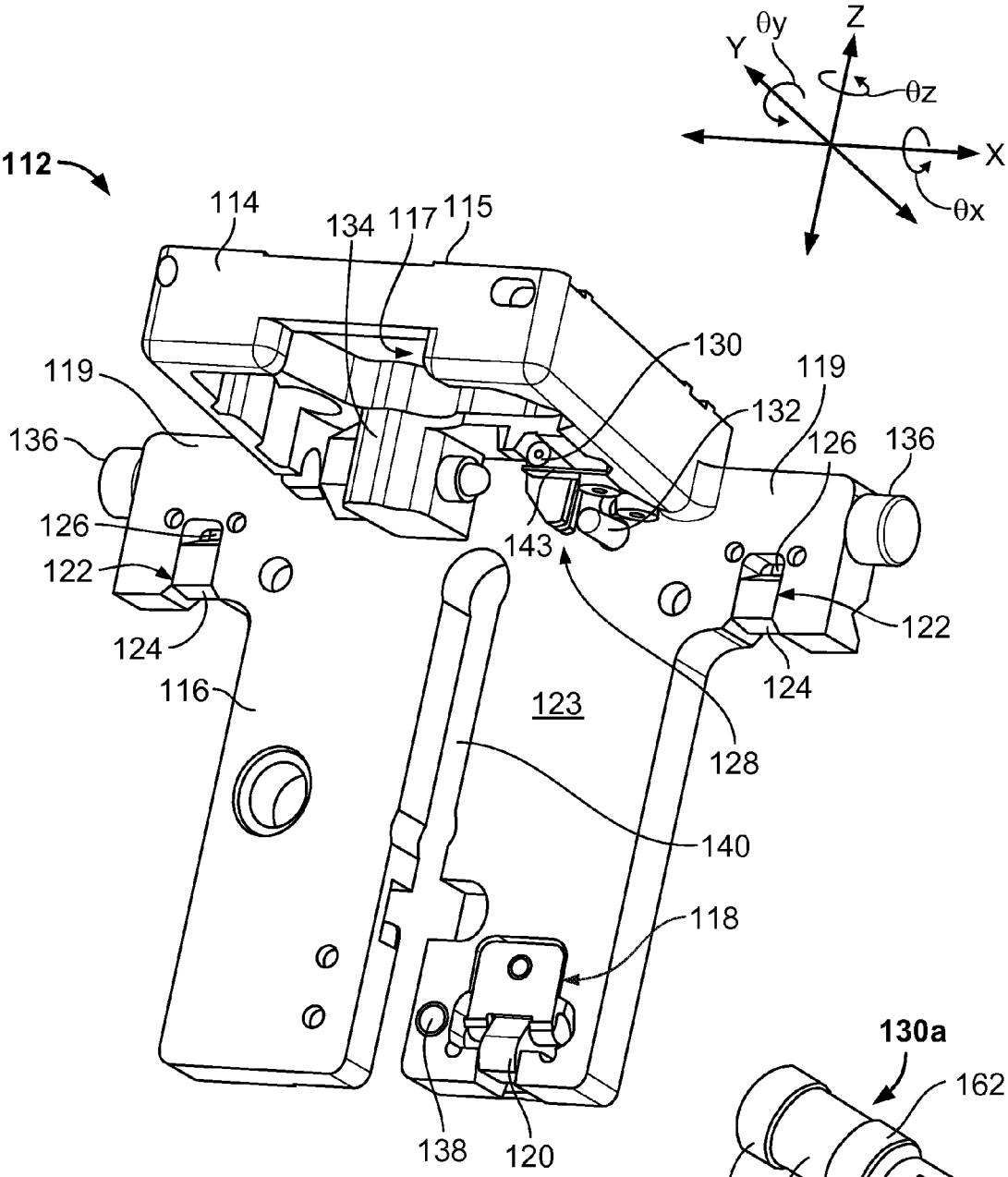
FIG. 2 is a perspective view of a mounting bracket for securing a printhead to a print frame (the mounting bracket in FIGS. 2-4 is shown in an upside down orientation relative to how the mounting bracket would attach to the fluid ejection module in FIG. 1).

FIG. 2 shows an example mounting bracket 112 that is suitable for securing the fluid ejection module 100 to a print frame (e.g., print frame 142, see FIG. 4) in proper alignment. The mounting bracket 112 includes a support strut 114 to carry the fluid ejection module 100, and an alignment strut 116 that can be affixed directly to the print frame 142. In this example, the support strut 114 and the alignment strut 116 are connected to one another in a perpendicular alignment so as to form an "L-bracket". However, other configurations could also be used. Further, although the two struts are shown here as a monolithic body, it may also be possible to initially form them as separate components and subsequently connect them together.

As noted above, the support strut 114 is configured to carry the fluid ejection module 100. In particular, the support strut 114 includes an outer surface 115 (on a side of the support strut 114 further from the alignment strut 116) adapted to receive the mounting component 108 of the fluid ejection module 100, and an opening 117 that is designed to accommodate the housing 106. When the fluid ejection module 100 is properly coupled to the mounting bracket 112, the mounting component 108 sits flat on the outer surface 115 exposing the nozzle plate of the die 104 (see FIG. 3).

The alignment strut 116 includes several mechanical components for aligning the mounting bracket 112, and consequently the printhead 102 of the fluid ejection module 100, with respect to the print frame 142. The various components can be designed to align the mounting bracket 112 to the print frame 142 in each of three orthogonal linear directions (namely, the x, y and z directions) and three orthogonal angular direction (namely, the θx, θy, and θz directions). In this example, the alignment strut 116 includes a first alignment mechanism 118, a second alignment mechanism 122, and a third alignment mechanism 128. The alignment mechanisms are adjustable and configured to orient the mounting bracket 112 on the print head when the alignment strut 116 is affixed to the print frame 142. As described below, the first and second alignment mechanisms 118 and 122 can be appropriately adjusted and mechanically fixed in place before the mounting bracket 112 is installed on the print frame 142.

The first alignment mechanism 118 is configured to orient the mounting bracket 112 with respect to the print frame 142 in a first angular direction ("the θx-direction"). In this example, the first alignment mechanism 118 includes an adjustable cam device integrated into an inner face 123 of the alignment strut 116, proximate its lower longitudinal end (i.e., the distal longitudinal end with respect to the support strut 114). The cam device includes a cam 120 that is movable in a second linear direction ("the y-direction") relative to the alignment strut 116, and a drive screw 121 (see FIG. 3) to operate the cam. For example, the cam 120 can be functionally coupled to the drive screw 121, such that appropriate actuation of the drive screw drives the cam backwards and forwards in the y-direction relative to the alignment strut 116 and relative to the alignment features 136. A standoff 138, which includes a ball bearing held by a counter-bore formed in the alignment strut 116, protects the cam 120. The first alignment mechanism 118 can also be designed such that the cam 120 rotates about an axis extending in the x-direction.

A "cam" as used in the present disclosure refers to any movable component designed to facilitate relative movement between the mounting bracket and a supporting structure (e.g., a print frame). The cam can have any suitable type of curved or radial surface. For example, the cam can be provided in the shape of an eccentric wheel, an irregularly shaped cylinder, and/or a sphere.

When the alignment strut 116 is affixed to the print frame 142 the cam 120 bears against an outer surface 144 of the print frame (see FIG. 4), displacing the lower end of the alignment strut away from the print frame in the y-direction, and thus orienting the mounting bracket 112 in the θx-direction. Corrections of the bracket's orientation in the θx-direction with respect to the print frame 142 can be achieved by adjusting the position of the cam 120 using the drive screw 121. For example, adjusting the cam 120 can force relative movement between the lower end of the alignment strut 116 and the print frame outer surface 144. This relative movement causes the bracket 112 to tilt or rotate in the θx-direction relative to the stationary print frame 142. As described below, the alignment features 136 are set in the y-direction when the bracket is installed on the print frame 142. Accordingly, the axis of rotation in the θx-direction for the bracket 112 can pass through the alignment feature 136.

The cam device of the first alignment mechanism 118 can be specifically designed to facilitate micro-adjustments (e.g., adjustment of 100 microns or less) of the bracket's orientation with respect to the print frame 142. In some examples, positioning the cam 120 farther away from the longitudinal center point of the alignment strut 116 provides more fine-tuned control of the bracket's angular position in the θx-direction. As noted above, in some implementations, the first alignment mechanism 118 can be adjusted and mechanically fixed in place prior to installation on the print frame 142. In such cases, any adjustments or corrections in the orientation of the mounting bracket 112 can be made using a suitable alignment apparatus (as discussed below).

The second alignment mechanism 122 is configured to orient the mounting bracket 112 with respect to the print frame 142 in a second angular direction ("the θy-direction) and a third linear direction ("the z-direction"). In this example, the second alignment mechanism 122 includes a pair of adjustable cam devices integrated into opposing flange sections 119. The flange sections 119 extend laterally outward from the main body of the alignment strut 116. Each of the cam devices includes a cam 124 that is movable in the z-direction relative to the alignment strut 116, and a drive screw 126 to operate the cam. The cams 124 are operated independently by the separate drive screws 126. For example, each of the cams 124 can be functionally connected to a respective drive screw 126, such that actuation of the drive screw drives the cam backwards and forwards in the z-direction relative to the alignment strut 116. The second alignment mechanism 122 can also be designed such that the cams 124 rotate about an axis extending in the x-direction.

When the alignment strut 116 is affixed to the print frame 142 (see FIG. 4), the cams 124 bear against a first set of support elements 146 on the print frame, independently displacing the lateral ends of the alignment strut from the print frame in the z-direction, and thus orienting the mounting bracket 112 in the θy-direction and the z-direction. Corrections of the bracket's orientation in either the θy-direction and/or the z-direction can be achieved by adjusting the position of the cams 124 using the corresponding drive screws 126. For example, adjusting the cams 124 can force relative movement between the lateral ends of the alignment strut 116 and the print frame support elements 146. This relative movement can cause the bracket to move in either, or both of, the θy-direction and the z-direction. In particular, movement (e.g., rotating or tilting) in the θy-direction is effected by a difference in the positional adjustment of the cams 124. For example, when one of the cams 124 is adjusted more or less than the other cam, or when the cams are adjusted in opposite z-directions (e.g., when one of the cams is moved upwards and the other cam is moved downwards). In some examples, positioning the cams 124 farther away from the lateral center point of alignment strut 116 provides more fine-tuned control of the bracket's angular position in the θy-direction. Movement (e.g., translating movement) of the mounting bracket 112 in the z-direction is effected when cams 124 are moved on the same course in the z-direction (e.g., when both of the cams are moved upwards or downwards). The cam devices of the second alignment mechanism 122 can be specifically designed to facilitate micro-adjustments (e.g., adjustments of 100 microns or less) of the bracket's orientation with respect to the print frame 142. As noted above, in some implementations, the second alignment mechanism 122 can be adjusted and mechanically fixed in place prior to installation on the print frame 142. In such cases, any adjustments or corrections in the orientation of the mounting bracket 112 can be made using a suitable alignment apparatus (as discussed below).

The third alignment mechanism 128 is configured to orient the mounting bracket 112 with respect to the print frame 142 in a first linear direction ("x-direction"). In this example, the third alignment mechanism 128 includes an adjustable cam device positioned against the inner face 123 of the alignment strut 116, proximate its upper longitudinal end (i.e., the proximal longitudinal end with respect to the support strut 114). The cam device includes a cam 130 that is movable relative to the alignment strut 116 in the θy-direction, a drive screw 132 (see FIG. 2) to operate the cam, and a securing mechanism 134 designed to hold the cam against the print frame 142. For example, the cam 130 can be functionally coupled to the drive screw 132, such that appropriate actuation of the drive screw rotates the cam about an axis extending in the y-direction. The drive screw 132 is designed to be accessible when the bracket 112 is installed on the print frame 142 (see FIG. 3).

When the alignment strut 116 is affixed to the print frame 142 the cam 130 bears against a fixed pin of the print frame (not shown) positioned between the cam and the securing mechanism 134, thus orienting the mounting bracket 112 in the x-direction. In some examples, the cam 130 is coupled to a loading spring (e.g., a leaf spring) that cooperates with a retainer plate 143 to pre-load the cam device. The securing mechanism 134, which can also be spring loaded, provides a force to bias the cam 130 against the fixed pin. Corrections of the bracket's orientation in the x-direction with respect to the print frame 142 can be achieved by adjusting the position of the cam 130 using the drive screw 132. For example, adjusting the cam 130 can force relative movement in the x-direction between the bracket 112 and the fixed pin of the print frame 142. This relative movement causes the bracket 112 to slide or translate in the x-direction relative to the stationary print frame 142. The cam 130 is mounted so as to be held in place by a friction force on the drive screw 132, which can inhibit unintentional adjustments. The cam device of the third alignment mechanism 128 can be specifically designed to facilitate micro-adjustments (e.g., adjustments of 20 microns or less) of the bracket's orientation with respect to the print frame 142.

Figure 2A:
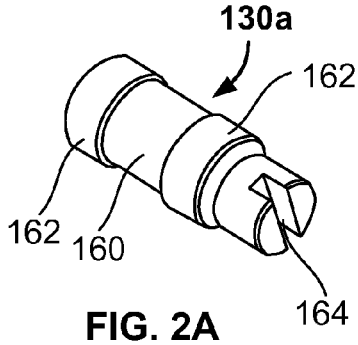
FIG. 2A is a perspective view of an example eccentric cam.

FIG. 2A shows an example eccentric cam 130*a*. The eccentric cam 130*a* includes an eccentric portion 160 that bears directly against fixed pin of the print frame 142 to facilitate x-direction adjustments to the position of the bracket 112. The eccentric portion 160 is situated between two stoppers 162. The stoppers 162 are larger in diameter than the eccentric portion 160 and bear against the retainer plate 143 to inhibit unintentional rotation of the cam 130*a*. A slot 164 at the innermost end of the cam 130*a* is designed to directly engage an adjustment tool, so as to obviate the need for a drive screw.

Figure 4:
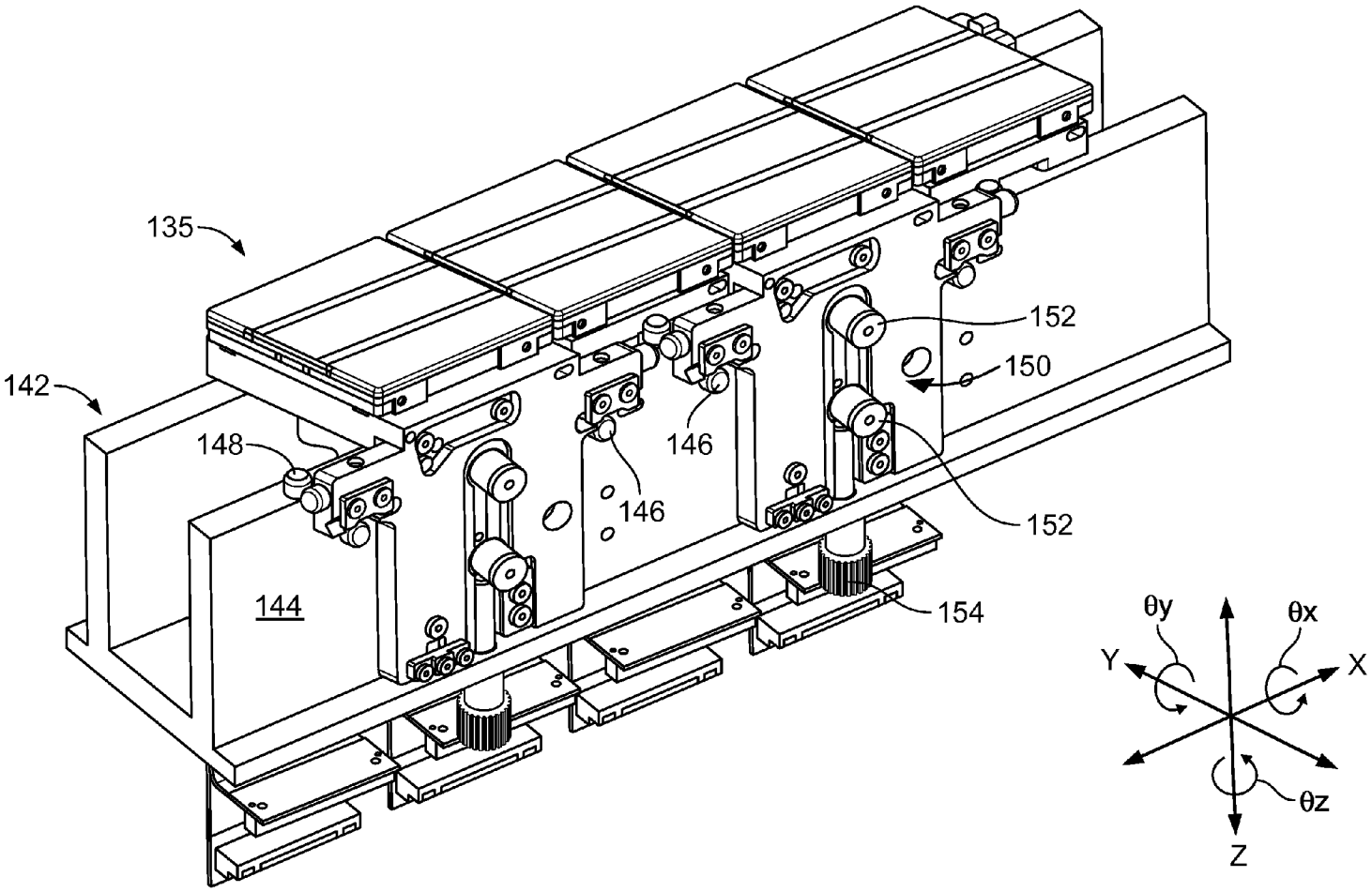
FIG. 4 is a perspective view of a print frame carrying multiple module-bracket assemblies.

A pair of alignment features 136 provides yet another component on the alignment strut 116 for aligning the mounting bracket 112, and the attached printhead 102, with respect to the print frame 142. For example, the alignment features 136 can be configured to orient the mounting bracket 112 with the print frame 142 in a third angular direction ("the θz-direction) and the y-direction. In this example, the alignment features 136 are static structures (e.g., bumpers or ball bearings) that extend laterally outward from each of the opposing flange sections 119. As shown in FIG. 4, when the alignment strut 116 is affixed to the print frame 142, the alignment features 136 bear against a second set of support elements 148 on the print frame to orient the mounting bracket 112 in the θz-direction and the y-direction.

Figure 3:
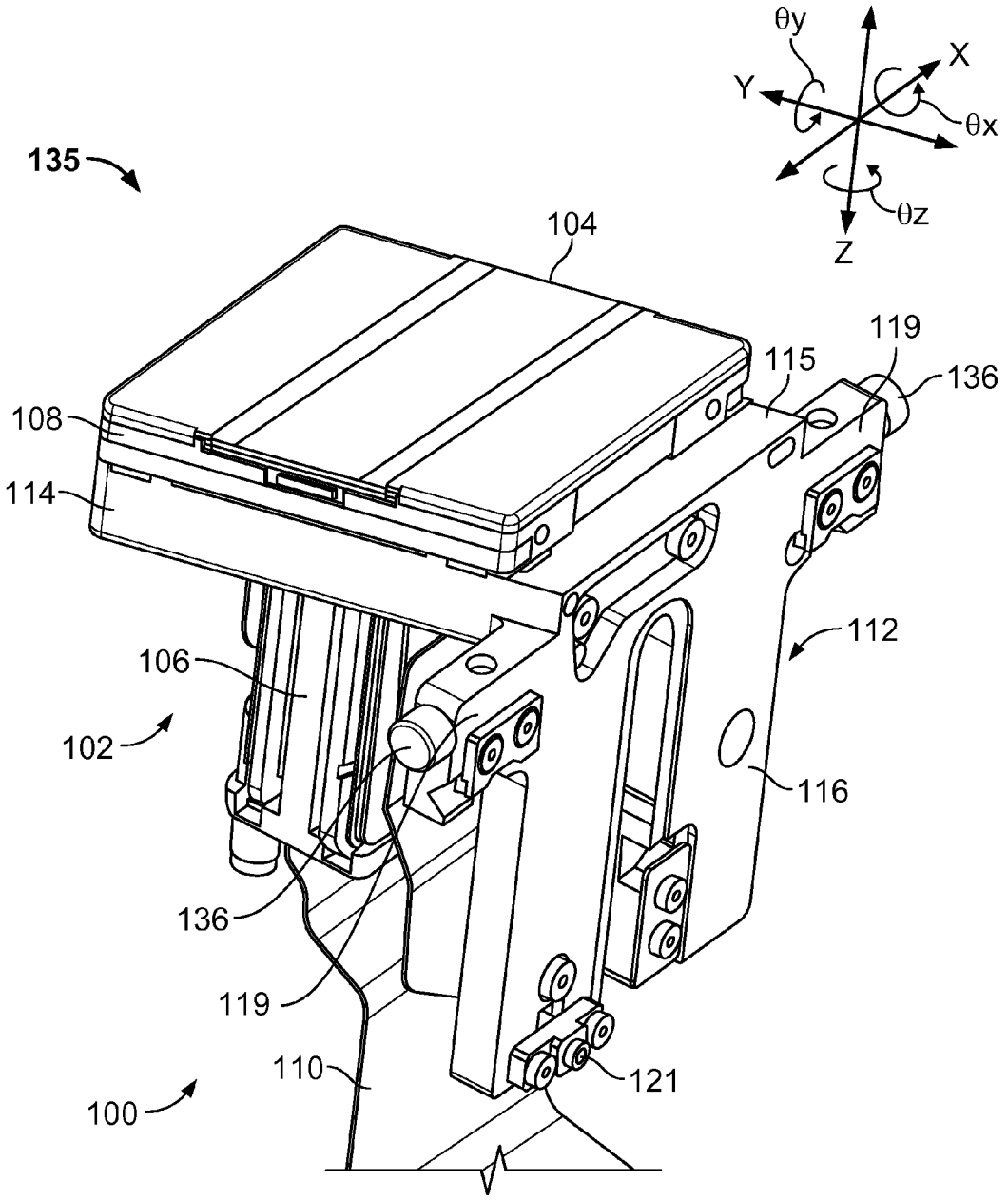
FIG. 3 is a perspective view of a module-bracket assembly.

FIG. 3 shows the fluid ejection module 100 attached to the mounting bracket 112, providing a module-bracket assembly 135. As shown, the mounting component 108 of the printhead 102 sits relatively flat on the outer surface 115 of the support strut 114, while the housing 106 projects through the opening (117) (shown in FIG. 2), exposing the nozzle plate of the die 104. The mounting component 108 can be permanently bonded to the support strut 114. For example, an appropriate adhesive, such as an epoxy or any UV curable adhesive can be used to bond the mounting component 108 to the support strut 114. In the case of an epoxy, a heater can be placed between the mounting component 108 and the mounting bracket 112 to provide local heating. The mounting component 108 can be aligned to the bracket 112, prior to bonding using an alignment apparatus (as described below).

FIG. 4 shows multiple module-bracket assemblies 135 installed on the print frame 142. As shown, the module-bracket assemblies 135 are installed on alternating sides down the length of the print frame 142. In some examples, the nozzles on the die are arranged to be symmetric about a point to compensate for the alternating pattern. This alternating pattern allows the printheads 102 (particularly the dies 104) to be aligned directly adjacent to one another while accommodating the mounting brackets 112. In addition, the alternating arrangement permits the brackets 112 to be wider than the printheads 102. In fact, the cams 124 of the second alignment mechanism 122 as well as the alignment features 136 can be further apart in the x-direction than the center-to-center spacing (i.e., the pitch) of the printheads 102 on the print frame 142 in the x-direction. In some cases, a wider bracket can provide for greater alignment accuracy than a narrower bracket. The printheads 102 can be positioned in a side-by-side arrangement, e.g., along the x-direction.

Each of the mounting brackets 112 is provided with a guide slot 140 formed into the alignment strut 116 to facilitate installation on the print frame 142. To install the mounting bracket 112, the guide slot 140 is aligned over a locking mechanism 150 of the print frame 142, and guided downward until the cams 124 of the second alignment mechanism meet the first set of support elements 146. The locking mechanism 150 includes a first locking component 152 for securing the bracket 112 to the print frame 142 in the z-direction, and a second locking component 154 for securing the bracket to the print frame in the y-direction. The locking components 152 and 154 may include spring loaded fasteners.

Precise alignment of the printhead 102, in each of the six linear and angular directions, with respect to the print frame 142 is desirable for accurate fluid ejection (e.g., printing). Further, when combining two or more printheads 102 for printing (as shown in FIG. 4), it may be desirable to have each of the printheads be precisely aligned relative to one another for printing accuracy.

The y-direction is the direction of travel of the print medium on which fluid is deposited by the printheads 102. Incorrect positioning of the printhead 102 (the die 104 in particular) in the y-direction can result in incorrect droplet deposition. In some cases, inconsistent (e.g., non-uniform) positioning of the die 104 in the y-direction between multiple printheads 102 can be at least partially corrected by controlling the relative timing of ejection of fluid from the nozzles (e.g., using computer software). As shown in FIG. 4, the printheads 102 can be aligned side-by-side in the x-direction. Incorrect positioning of the die 104 in the x-direction can cause visible printing errors, e.g., streaks or lines on the print medium. These printing errors cannot be corrected by adjusting the timing of fluid ejection from the nozzles. The z-direction is the direction in which the fluid droplets are ejected from the nozzles in the die 104. Inconsistent positioning of the die 104 in the z-direction between multiple printheads 102 (i.e., positioning one die closer to the print medium than another die) can cause the ejected fluid droplets to be of non-uniform size and shape.

It can be difficult to completely align the module-bracket assembly 135 after it is installed on the print frame 142, particularly when just one printhead 102 is being added to a configuration that is already installed and aligned (for example, when a damaged or worn printhead is being replaced). Accordingly, the module-bracket assembly 135 can be at least partially "pre-configured" or "pre-aligned" before installation on the print frame 142. For example, the first and second alignment mechanisms 118 and 122 on the alignment strut 116 can be appropriately adjusted, and mechanically fixed in the adjusted position, prior to installation.

As noted above, adjustment of the first and second alignment mechanisms 118 and 122 pre-aligns the module-bracket assembly 135 in the θx-direction, the θy-direction, and the z-direction. Further, when the module-bracket assembly 135 is installed, the alignment features 136 cooperate with the print frame 142 to align the assembly in the y-direction and the θz-direction. The third alignment mechanism 128, which facilitates corrections in the x-direction orientation of the module-bracket assembly 135, can remain adjustable when the module-bracket assembly 135 is installed on the print frame 142. Leaving the third alignment mechanism 128 adjustable at installation can allow for some isolated flexibility in the pixel adjustment of the printhead 102. Further, in some implementations, it may be advantageous to leave the third alignment mechanism 128 in an adjustable state during installation, because corrections in the x-direction alignment of the printhead 102 may not be possible using electronics (e.g., software for adjusting nozzle firing times, etc.).

Figure 5:
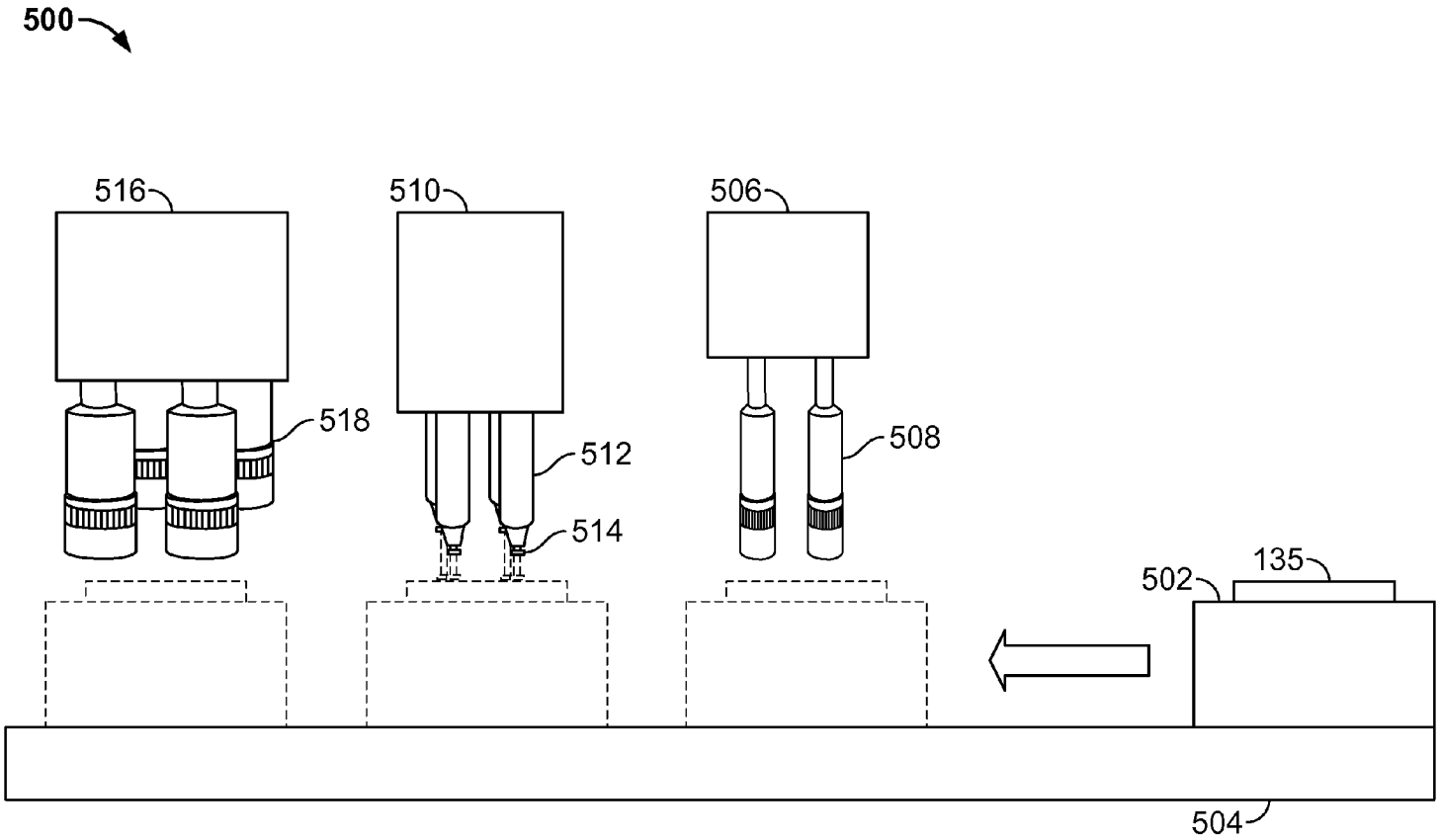
FIG. 5 is a diagram of an alignment apparatus.

FIG. 5 provides a diagram of an example alignment apparatus 500 designed to pre-align the module-bracket assembly 135. The diagram is provided solely for the purpose of this discussion and should not be considered limiting. The actual configuration of the alignment apparatus 500 may vary. In this illustration, the alignment apparatus 500 includes a movable base 502 riding on a track 504. The base 502 is designed such that installation of the module-bracket assembly 135 on the base is similar (if not identical) to the installation arrangement on the print frame 142. For example, the base 502 can include a chassis designed to simulate the print frame 142 (e.g., having similar connections and alignment features). The base 502 is arranged to move along the track 504, carrying the module-bracket assembly 135 to a first alignment station 506, a second alignment station 510, and a third alignment station 516. The alignment stations are designed to facilitate pre-alignment of the module-bracket assembly 135.

The first alignment station 506 is designed to facilitate a rough alignment of the printhead 102 on the support strut 114. Accordingly, the first alignment station 506 includes a pair of low magnification cameras 508. To implement the rough alignment, the printhead 102 can be adjusted on the support strut 114 until the low magnification cameras 508 are appropriately aligned with fiducials provided on the exposed nozzle plate of the printhead die 104.

Figure 6:
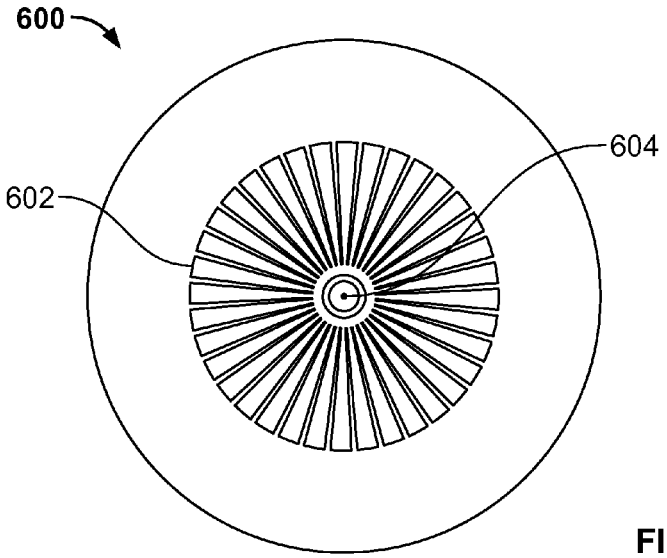
FIG. 6 is a diagram of an example fiducial.

FIG. 6 shows a schematic representation of an implementation of a fiducial 600 that is suitable for use with the alignment apparatus 500. In this implementation, the fiducial 600 includes conspicuity features 602 arranged around a fiducial point 604. The conspicuity features 602 can be sized to be conspicuous to the low magnification cameras 508, and can facilitate locating of the fiducial point 604 with high magnification cameras (e.g., high magnification cameras 518). References in this disclosure to alignment with a fiducial 600 can refer to alignment with the conspicuity features 602 or the fiducial point 604. That is, for example, aligning a low magnification camera with a fiducial can include aligning the low magnification camera with the conspicuity features; and aligning a high magnification camera with a fiducial can include aligning the high magnification camera with the fiducial point.

Turning back to FIG. 5, the second alignment station 510 is designed for alignment of the module-bracket assembly 135 with respect to the print frame 142. In particular, the second alignment station 510 facilitates adjustment of the first and second alignment mechanisms 118 and 122. As noted above, the first alignment mechanism 118 is configured to orient the module-bracket assembly 135 in the θx-direction, and the second alignment mechanism is configured to orient the module bracket assembly in the θy direction and the z-direction.

As shown, the second alignment station 510 can include a set of four height gauges 512. Each of the height gauges 512 is provided with a telescoping pin 514 operable to move vertically downward into contact with the exposed nozzle plate surface of the printhead die 104. Each of the pins 514 contacts the nozzle plate at a different surface location. The height gauges 512 are designed to measure a coordinate value corresponding to the relative vertical position (or a relative height) at each point of contact between the pins 514 and the nozzle plate surface. The first and second alignment mechanisms 118 and 122 can be adjusted (as described above) until the coordinate values provided by the height gauges 512 match, within a predetermined threshold, a set of corresponding "target coordinate values". These target coordinate values represent a correctly aligned orientation of the module-bracket assembly 135. After adjustment, the first and second alignment mechanisms 118 and 122 can be mechanically fixed in place. For example, the respective cams 120 and 124 can be mechanically fixed using an adhesive or an appropriate locking device.

The target coordinate values are determined using a reference gauge (not shown). The reference gauge accuracy is determined by measuring it on a three axis coordinate measuring machine. The reference gauge is a high tolerance, structural representation of a precisely aligned module-bracket assembly. To determine the target coordinate values, the reference gauge is loaded into the base 502 and carried to the second alignment station 510. At the second alignment station 510, the height gauges 512 are calibrated using the reference gauge.

The third alignment station 516 is designed to facilitate a fine alignment of the printhead 102 on the support strut 114. Accordingly, the third alignment station 516 includes a set of four high magnification cameras 518. Features on the reference gauge (e.g., fiducials) can be used to calibrate the cameras 518. To implement the fine alignment, the printhead 102 can be adjusted on the support strut 114 until the high magnification cameras 518 are appropriately aligned with the fiducials on the exposed nozzle plate of the printhead die 104. After adjustment, the printhead 102 can be bonded to the support strut 114.

Figure 7:
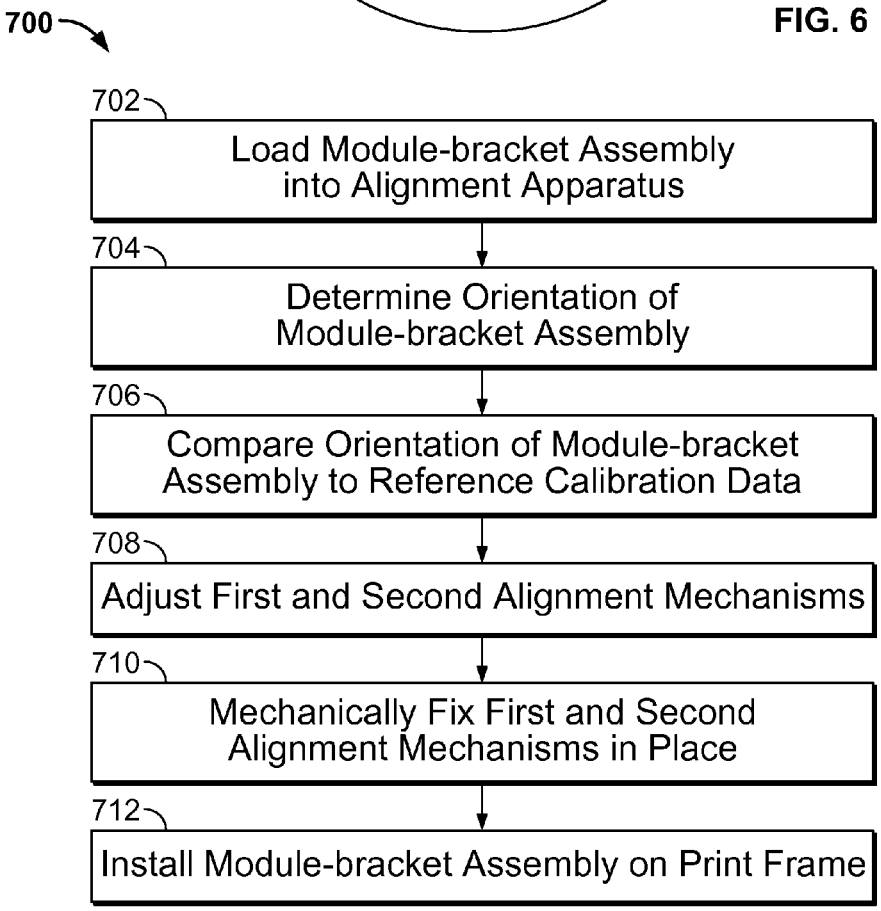
FIG. 7 is a flowchart of an example process for mounting a fluid ejection module to a print frame.

FIG. 7 is a flowchart showing an example process 700 for mounting a fluid ejection module to a print frame. For illustrative purpose, the process 700 is described in the context of mounting the example fluid ejection module 100 to the example print frame 142 using the alignment apparatus 500. It is understood, however, that the process 700 can be implemented to mount a different configured fluid ejection module 100 to the same or a differently configured print frame 142 using the same or a differently configured alignment apparatus.

According to the process 700, the module-bracket assembly 135 is loaded into the alignment apparatus 500 (step 702). For example, the module-bracket assembly 135 can be loaded into a base 502 of the alignment apparatus. The base 502 can include a chassis design to simulate the print frame 142. The orientation of the module-bracket assembly 135 is determined (step 704). For example, a set of height gauges 512, at a second alignment station 510 of the alignment apparatus 500, can be used to determine coordinate values associated with multiple positions on the exposed nozzle plate surface of the printhead die 104. The coordinate values can correspond to a relative height of the nozzle plate surface. The orientation of the module-bracket assembly is compared to reference calibration data (step 706). The reference calibration data can include a set of target coordinate values determined using a reference gauge structure. The first and second alignment mechanisms 118 and 122 can be adjusted based on the reference calibration data (step 708). For example, the first and second alignment mechanisms 118 and 122 can be adjusted until the coordinate values measured by the height gauges 512 match the set of target coordinate values. The first and second alignment mechanisms 118 and 122 are mechanically fixed in place (step 710). For example, the respective cams 120 and 124 can be immobilized using an adhesive or a mechanical locking device. The module-bracket assembly 135 is installed on the print frame 142 (step 712). Once installed, the module-bracket assembly 135 is precisely aligned to the print frame 142 in each of five of six directions, namely, the θx, θy, and θz, y and z directions. Alignment in the x-direction can be adjusted after securing the module-bracket assembly 135 to the print frame 142.

The use of terminology such as "front," "back," "top," "bottom," "over," "above," and "below" throughout the specification and claims is for describing the relative positions of various components of the system, printhead, and other elements described herein. Similarly, the use of any horizontal or vertical terms to describe elements is for describing relative orientations of the various components of the system, printhead, and other elements described herein. Unless otherwise stated explicitly, the use of such terminology does not imply a particular position or orientation of the printhead or any other components relative to the direction of the Earth gravitational force, or the Earth ground surface, or other particular position or orientation that the system, printhead, and other elements may be placed in during operation, manufacturing, and transportation.

A number of embodiments of the invention have been described. Nevertheless, it will be understood that various modifications may be made without departing from the spirit and scope of the inventions.

What is claimed is:

1. A bracket for mounting a fluid ejection module to a frame, the bracket comprising:

a support strut configured to carry the fluid ejection module; and an alignment strut coupled to the support strut and configured to affix to the frame so as to orient the support strut with respect to the frame in each of three orthogonal linear directions and three orthogonal angular directions, the alignment strut comprising:

a first alignment mechanism comprising a first adjustable alignment feature configured to bear against the frame so as to orient the support strut in a first angular direction when the alignment strut is affixed to the frame;

a second alignment mechanism comprising a second adjustable alignment feature configured to bear against the frame so as to orient the support strut in a second angular direction and in a third linear direction when the alignment strut is affixed to the frame; and a third alignment mechanism comprising a third adjustable alignment feature configured to bear against the frame so as to orient the support strut in a first linear direction when the alignment strut is affixed to the frame, wherein each of the first and second alignment features is held mechanically fixed on the alignment strut in a respective aligned position, and the third alignment mechanism is movable on the alignment strut.

2. The bracket of claim 1, wherein the aligned position of the first alignment feature comprises a position that causes the support strut to be level with respect to the frame in the first angular direction, and wherein the aligned position of the second alignment feature comprises a position that causes the support strut to be level with respect to the frame in the second angular direction.

3. The bracket of claim 1, wherein the support strut is substantially perpendicular to the alignment strut.

4. The bracket of claim 1, wherein the first alignment mechanism comprises a cam device positioned at a distal end of the alignment strut, relative to the support strut.

5. The bracket of claim 1, wherein the second alignment mechanism comprises a pair of cam devices positioned on opposing lateral sides of the alignment strut.

6. The bracket of claim 5, wherein each of the cam devices is adjustable independently of the other cam device.

7. The bracket of claim 1, wherein the third alignment mechanism comprises a cam device positioned at a proximal end of the alignment strut relative to the support strut.

8. The bracket of claim 1, further comprising a fourth alignment feature configured to orient the support strut in a second linear direction when the alignment strut is affixed to the frame; and wherein the fourth alignment feature comprises a pair of bumpers fixedly positioned on opposing lateral sides of the alignment strut, the bumpers being configured to bear against a portion of the frame when the alignment strut is affixed to the frame.

9. The bracket of claim 1, wherein the alignment strut defines a guide slot configured to receive a mechanical locking component for affixing the alignment strut to the frame.

10. The bracket of claim 1, wherein the support strut and the alignment strut are connected to one another in a perpendicular alignment so as to form the bracket in an L-shape.

11. A method for pre-aligning the bracket of claim 1 by means of an alignment apparatus comprising a base frame, the method comprising:

coupling the bracket to the base frame of the alignment apparatus;

determining, using the alignment apparatus, an orientation of the bracket with respect to the base frame;

comparing the orientation of the bracket to reference calibration data;

adjusting at least one of the first and second alignment mechanisms based on the comparison; and mechanically fixing at least one of the first and second alignment mechanisms in place.

12. The method of claim 11, wherein determining the orientation of the bracket comprises measuring a coordinate value at each of a plurality of positions on a surface of the fluid ejection module.

13. The method of claim 12, wherein adjusting the first and second alignment mechanisms comprises adjusting the first and second alignment mechanisms such that each of the measured coordinate values matches, within a predetermined threshold, a corresponding target coordinate value of the calibration data.

14. The method of claim 11, wherein the first alignment mechanism comprises a movable cam comprising the first alignment feature, and wherein adjusting at least one of the first and second alignment mechanisms comprises moving the cam in the second linear direction relative to the base frame.

15. The method of claim 11, wherein the second alignment mechanism comprises a pair of independently movable cams comprising the second alignment feature, and wherein adjusting at least one of the first and second alignment mechanisms comprises independently moving the cams in the third linear direction relative to the base frame.

16. The method of claim 11, further comprising securing the fluid ejection module to the support strut in an aligned position.

17. The method of claim 16, wherein securing the fluid ejection module to the support strut comprises:

before determining the orientation of the bracket, implementing a rough fiducial alignment of the fluid ejection module with respect to the support strut; and after adjusting at least one of the first and second alignment mechanisms, implementing a fine fiducial alignment of the fluid ejection module with respect to the support strut.

18. The method of claim 11, further comprising obtaining the reference calibration data by:

coupling a reference gauge component to the base frame of the alignment apparatus; and determining, using the alignment apparatus, an orientation of the reference gauge with respect to the base frame.

19. The method of claim 11, wherein the alignment strut further comprises a third alignment mechanism comprising a third alignment feature bearing against the base frame so as to orient the fluid ejection module in a first linear direction, and wherein mechanically fixing at least one of the first and second alignment mechanisms in place comprises leaving the third alignment feature adjustable.

20. A bracket for mounting a fluid ejection module to a frame, the bracket comprising:

a support strut configured to carry the fluid ejection module; and an alignment strut coupled to the support strut and configured to affix to the frame so as to orient the support strut with respect to the frame in each of three orthogonal linear directions and three orthogonal angular directions, the alignment strut comprising:

a first alignment mechanism comprising a first cam movable in a second linear direction, the first cam being positioned at a distal end of the alignment strut relative to the support strut, the first cam being configured to bear against the frame so as to orient the support strut in a first angular direction when the alignment strut is affixed to the frame;

a second alignment mechanism comprising a pair of second cams movable in a third linear direction, the pair of second cams being positioned on opposing lateral side flanges of the alignment strut, the pair of second cams being configured to bear against the frame so as to orient the support strut in a second angular direction and in a third linear direction when the alignment strut is affixed to the frame; and a third alignment mechanism comprising a third cam movable in a second angular direction, the third cam being positioned at a proximal end of the alignment strut relative to the support strut, the third cam being configured to bear against the frame so as to orient the support strut in a first linear direction when the alignment strut is affixed to the frame.

* * * * *